United States Patent [19]

Mouri et al.

[11] Patent Number: 4,911,977

[45] **Date of Patent: * Mar. 27, 1990**

[54] RECORDING MEMBER

[75] Inventors: Hidemasa Mouri; Michiaki Tobita, both of Yokohama; Naonobu Eto, Fujisawa, all of Japan

[73] Assignee: Canon Kabushiki Kaisha, Tokyo, Japan

[ * ] Notice: The portion of the term of this patent subsequent to Feb. 10, 2004 has been disclaimed.

[21] Appl. No.: 9,583

[22] Filed: Jan. 29, 1987

Related U.S. Application Data

[63] Continuation of Ser. No. 736,758, May 22, 1985, abandoned.

[30] Foreign Application Priority Data

May 25, 1984 [JP] Japan ..... 59-105966

[51] Int. Cl.[4] ..... B41M 5/00

[52] U.S. Cl. ..... 428/220; 346/135.1; 428/195; 428/207; 428/304.4; 428/323; 428/332; 428/334; 428/335; 428/336; 428/423.1

[58] Field of Search ..... 428/207, 211, 323, 327–331, 428/334–336, 913, 914, 220, 195, 304.4, 332, 423.1; 346/135.1; 528/76, 77, 79, 74.5, 67

[56] References Cited

U.S. PATENT DOCUMENTS

| | | | |
|---|---|---|---|
| 4,049,871 | 9/1977 | Ogawa et al. | 428/900 |
| 4,302,552 | 11/1981 | Hongu et al. | 521/176 |
| 4,439,486 | 3/1984 | Yamada et al. | 428/900 |
| 4,481,244 | 11/1984 | Haruta et al. | 428/342 |
| 4,496,629 | 1/1985 | Haruta et al. | 428/342 |
| 4,550,053 | 10/1985 | Ryuichi et al. | 428/304.4 |
| 4,642,247 | 2/1987 | Mouri et al. | 427/214 |

*Primary Examiner*—Bruce H. Hess
*Assistant Examiner*—P. R. Schwartz
*Attorney, Agent, or Firm*—Fitzpatrick, Cella, Harper & Scinto

[57] ABSTRACT

A recording member comprises a condensation product of an isocyanate compound and a polyether-polyol. A recording member comprises a substrated and an ink-receiving layer formed thereon in which a condensation product of an isocyanate compound and a polyether-polyol is contained. A recording member comprises a condensation product of an isocyanate compound and a polyether-polyol as main component and is in the form of a film.

14 Claims, No Drawings

RECORDING MEMBER

This application is a continuation of application Ser. No. 736,758 filed May 22, 1985 now abandoned.

BACKGROUND OF THE INVENTION

1. Field of the Invention

This invention relates to a recording member for an ink-jet recording method, and more particularly to a member which is excellent in ink-receiving property and sharpness of an image recorded thereon.

2. Description of the Prior Art

The ink-jet recording method is that a recording is carried out by jetting droplets of a recording liquid (ink) generated by various systems for jetting the recording liquid (for example, an electrostatically attractive system, a system which mechanically vibrates and displaces the recording liquid using a piezo-electric device, a system employing pressure generated by foaming the recording liquid by heating or the like) and adhering all or part of the jetted droplets to the recording member such as paper and the like. Also, it is noteworthy that this recording method is characterized by small generation of noise during recording and capability of high speed writing and multi-color writing.

The recording liquid for the ink-jet recording method contains water as a main component, from aspects of safety and recording aptitude, and polyhydric alcohol is added to the recording liquid for preventing clogging of a nozzle and for improving jet stability, in many cases.

The recording member to be used for this ink-jet recording method includes common paper and a member composed of a substrate and a porous ink-absorbing layer formed thereon, which is designated as a ink-jet recording paper. Whereas, higher and extensive characteristics of the recording member are coming to be demanded with improvement of performance and spread of the ink-jet recording device enabling high speed recording or multi-color recording. Thus, for obtaining recorded images of high resolution and high quality, the recording member for the ink-jet recording is required to satisfy the fundamental requisite performances as shown below.

(1) To be as rapid as possible in absorption of the recording liquid to the recording member.

(2) When ink dots are overlapped, the recording member should not allow the recording liquid attached later to flow out into the ink dot previously attached.

(3) The recording member should not allow the droplet of the recording liquid to spread on it to cause the diameter of the ink dot to be larger than required.

(4) The recording member should allow the shape of the ink dot to be approximate true circle, and its circumference to be smooth.

(5) OD (optical density) of the ink dot should be high. Thereby, the recording member does not allow the circumference of the dot to be obscured.

In addition to the requisite performances as described above, the recording member is further required to satisfy the performances as shown below, for obtaining the recorded image of high resolution equaling a color photograph by a multi-color ink-jet recording method.

(6) To be excellent in color-generating property of a coloring component of an ink.

(7) To be especially excellent in fixing property since the same number of the droplets as that of colors of the ink happen to attach to the same spot with overlapping.

(8) To have a glassy surface.

(9) To have the high degree of whiteness.

An image recorded by the ink-jet recording method has been conventionally used chiefly for a surface image observation. However, development of a recording member appropriate to uses other than the surface image observation is coming to be demanded with improvement of performance and spread of the ink-jet recording device.

The uses other than the surface image observation may include those in which the recorded image is projected by means of optical instruments such as a slide, OHP (overhead projector) and the like on a screen, etc. for observation, color separating plate during preparation of positive plate for color printing, CMF (color mosaic filter) for color display of liquid crystal or the like.

While the diffused light of the recorded image is primarily observed when the recorded image is used for the surface image observation, the transmitted light passing through the recorded image is primarily observed in the recording member to be used for these uses (the uses other than the surface image observation). Accordingly, the recording member to be used for these uses is required to be excellent in light transmitting property, preferably, linear transmission factor in addition to the requisite performances of the general recording member for the ink-jet recording as described above. However, it is the real state that the recording member for transmittance observation has never satisfied all these requisite performances.

Also, the method for fixing the recording agent used in most conventional recording members for the surface image observation is such that a porous ink-receiving layer is formed thereon to absorb the recording liquid into the space formed in the layer. Thus, no gloss is observed on the surface of the recording member on account of the porousness. On the other hand, when the ink-receiving layer has a non-porous surface, there are the faults that, when coming into contact with the recorded image, clothes become dirty and the recorded image is impaired, because a non-volatile component such as polyhydric alcohol and the like in an ink remains in the surface of the recording member for hours after the recording was carried out, and the time for drying and fixing the ink is long.

SUMMARY OF THE INVENTION

An object of the present invention is to provide a recording member for an ink-jet recording which is particularly excellent in ink-receiving property and sharpness of a recorded image.

Another object of the present invention is to provide a recording member for an ink-jet recording which is excellent in ink-receiving property and has a porous ink-receiving layer as the surface.

A further object of the present invention is to provide a recording member for a full-color ink-jet recording which is excellent in ink-receiving property and sharpness of a recorded image, and which has an excellent glossy surface.

Still another object of the present invention is to provide a recording member for a ink-jet recording which can be used for formation of optical instruments such as a slide, OHP and the like on a screen, etc. for observation, by which a recorded image is projected, for formation of color separating plate during preparation of positive plate for color printing, for formation of CMF for color display of liquid crystal or the like.

According to one aspect of the present invention, there is provided a recording member which comprises a condensation product of an isocyanate compound and a polyether-polyol.

According to another aspect of the present invention, there is provided a recording member which comprises a substrate and an ink-receiving layer formed thereon in which a condensation product of an isocyanate compound and a polyether-polyol is contained.

According to a further aspect of the present invention, there is provided a recording member which comprises product of an isocyanate compound and a polyether-polyol as main component and is in the form of a film.

The above and other objects are attained by practicing the present invention as disclosed below.

Recording members of the present invention are characterized by containing a condensation product of an isocyanate compound and a polyether-polyol.

A portion, on which a recording is performed with an ink, of a recording member of the present invention, that is, an ink-receiving portion (as ink-receiving layer) contains at least the condensation product of the isocyanate compound and the polyether-polyol.

The condensation product of the isocyanate compound and the polyether-polyol contained in the recording member of the instant invention is an urethane compound, which are obtained by mixing the isocyanate compound and the polyether-polyol, and reacting the mixture, if desired, in the presence of catalyst such as dibutyl tin dilaurate, triethylenediamine and the like to introduce the isocyanate group to both ends of the resulting polyether-polyol.

The isocyanate compound which can be used for preparing said condensation product has two or more isocyanate groups per a molecule. Such compound, for example, having two isocyanate groups is exemplified by the following:

1,2-diisocyanatoethane, 1,2-diisocyanatopropane, tetramethylene-1,4-diisocyanate, pentamethylene-1,5-diisocyanate, hexamethylene-1,6-diisocyanate, nonamethylene-1,9-diisocyanate, decamethylene-1,10-diisocyanate, ω,ω'-dipropylether, diisocyanate, cyclohexane-1,4-diisocyanate, dicyclohexylmethane-4,4'-diisocyanate, hexahydrobiphenyl-4,4'-diisocyanate, hexahydrodiphenylether-4,4'-diisocyanate, phenylene-1,3-diisocyanate, plenylene-1,4-diisocyanate, toluylene-2,6-diisocyanate, toluylene-2,4-diisocyanate, 1-methoxybenzene-2,4-diisocyanate, 1-chlorophenylene diisocyanate, tetrachlorophenylene diisocyanate, m-xylylene diisocyanate, p-xylylene diisocyanate, diphenylmethane-4,4'-diisocyanate, diphenylsulfide-4,4'-diisocyanate, diphenylether-4,4'-diisocyanate,diphenylether-3,4'-diisocyanate, diphenylketone-4,4'-diisocyanate, naphthalene-2,6-diisocyanate, naphthalene-1,4-diisocyanate, naphthalene-1,5-diisocyanate, 2,4-biphenyl diisocyanate, 4,4'-biphenyldiisocyanate, 3,3'-dimethoxy-4,4'-biphenyl diisocyanate, anthraquinone-2,6-diisocyanate, triphenylmethane-4,4'-diisocyanate, azobenzene-4,4'-diisocyanate or the like. Futher, such compound having three isocyanate groups comprises compound represented by the following formulae (I)–(IV), and derivative thereof.

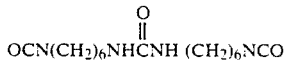
(I)

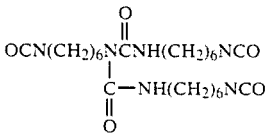
(II)

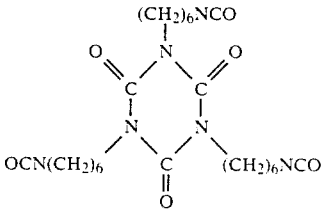
(III)

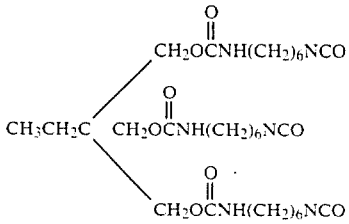
(IV)

One or more, if desired, selected from the above compounds can be used for preparing the condensation product.

The polyether-polyol which is the other component for preparing the condensation product has two or more hydroxy groups in a molecule and has an ether-bond therein. Such compound includes, for example, homopolymer of ethylene oxide (EO) and of propylene oxide (PO) or copolymer of (EO) and (PO); polyols such as ethylene glycol, glycerin, trimethylolpropane, trimethylolethane, pentaerythritol, sorbitol, sucrose, methyl glycoside and the like; an addition product prepared by adding, if desired, EO or PO to compound having two or more hydroxy groups, which are prepared by reacting aldehyde and carboxcylic acid such as tall oil, rhodinic acid, castor oil and the like with other compound such as olefinic compounds, aromatic hydrocarbons and the like; and derivative thereof. One or more selected, if desired, from these compounds can be used for preparing the condensation product.

A process for making the recording member of the present invention contaning the condensation product of the isocyanate compounds and the polyether-polyol is attained by mixing and reacting each prescribed amount of the isocyanate compound and the polyether-polyol, just prior to forming the portion of the recording member which should contain the condensation product (mainly, ink receiving layer) according to processes for forming the portions and by permitting the recording member to contain the reaction mixture.

That is, for example, when producing a film form of the recording member of the present invention, each prescribed amount of the isocyanate compound and the polyether-polyol may be contained in a composition for producing the recording member film during preparation of the composition. Also, when producing the recording member of the present invention, which comprises the substrate and an ink-receiving layer provided thereon, each prescribed amount of the isocyanate compound and the polyether-polyol may be contained in a composition such as a coating liquid and the like for producing an ink-receiving layer during preparation of the composition. Furthermore, compositions for producing the recording member may contain products which are represented by the following general formulae (V) and (VI) obtained by condensing separately, and condensation products of the products and isocyanate compositions and/or polyether-polyols.

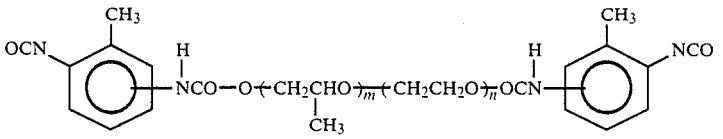

(V)

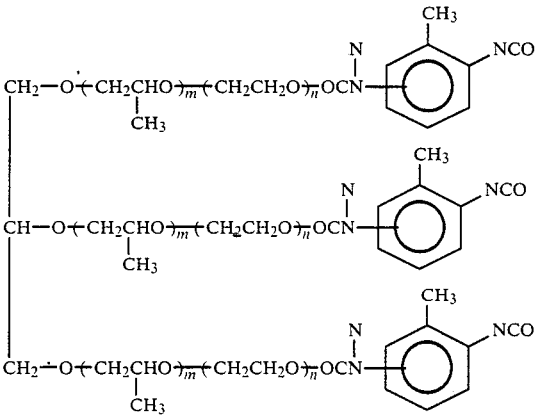

(VI)

In general, the recording member of the present invention comprises a substrate as a support and an ink-receiving layer provided thereon, and it may be allowed to unite the substrate and the ink receiving layer. The concrete embodiments are as follows:

(1) A type of a recording member which comprises a light-transmitting substrate and a light-transmitting ink-receiving layer containing the condensation product provided on the substrate.

The type of the recording member has a especially excellent light-transmitting property, and hence the member is used mainly in observing a recorded image projected on a screen or the like by use of optical instruments such as OHP and the like. That is, it is used as the recording member for light-transmit-observation.

In this case, as the light-transmitting substrate, there can be used a film or plate of polyester, diacetate, triacetate, acrylic type polymer, polycarbonate, polyvinyl chloride, polyimide, cellophane, celluloid and the like, or a glass plate or the like. According to recording purposes and uses of the recording member, the appropriate light-transmitting substrate can be selected from them.

On the other hand, an ink receiving layer may comprise only the condensation product or may contain the condensation product as a main component, and the ink-receiving layer may contain other high molecular material.

Such high molecular materials may include, for example, starch, casein, albumin, gum orbic, sodium alginate, polyvinyl alcohol, polyvinyl formal, ionomer resin, polyvinyl butyral, phenol resin, polyamide, polyacrylamide, polyvinyl pyrrolidone, ethylene-vinyl acetate copolymer, polyvinyl acetate or the like. One or more of them can be mixed with the condensation product.

Such ink-receiving layer can be produced by the following manner:

the isocyanate compound and the polyether-polyol are dissolved, if desired, in a solvent, or the condensation product are heated to melt; the resulting liquid is applied on the light-transmitting substrates by a roll coating method, a rod bar coating method, a spray coating method, an air knife coating method, a hot melt coating method or the like; and the thus applied layer is dried or cooled.

According to circumstances, in order to improve, if desired, an ink receiving property of an ink-receiving layer by means of making the porous surface of an ink-receiving layer, within the range of not inhibiting light transmitting property of a receiving member (not lowering linear transmission factor of a receiving member), it can be allowed to disperse filler such as fine powdered silica, clay, talc, diatomaceous earth, calcium carbonate, calcium sulfate, barium sulfate, aluminum silicate, synthetic zeolite, alumina, zinc oxide, lithopone, satin white and the like, in the ink-receiving layer. Further, it is not necessary for a light transmitting substrate and a light transmitting ink receiving layer to be non-colored and transparent. Thus, they may freely be a colored and transparent receiving member.

On the other hand, the recording member of present invention is desired to be sufficient in light transmitting property, in order to be mainly used for uses utilizing transmitted light through the images recorded on said recording member, for example, optical instruments such as slides, ohp, contact printer and the like.

The linear transmission factor (T%) as mentioned in the present invention refers to the spectral transmittance of the light, which enters vertically a sample, transmits through said sample, passes through the slit on the light-receiving side at a distance of at least 8 cm apart from said sample on the line elongated from the incident optical path and is received at the detector, as measured by means of, for example, Model 323 Hitachi Recording Spectrophotometer, (manufactured by Hitachi), and further determined from the measured spectral transmittance according to the following formula with the use of Y values of the tristimulus value of color:

$$T = Y/Y_0$$

T: linear transmission factor
Y: Y-value of sample;
$Y_0$: Y-value of blank.

Thus, the linear transmission factor mentioned in this invention is relative to the rectilinear light, and the present method for evaluation of the light transmitting property of the recording member by use of rectilinear light transmittance is different from the methods for evaluation of light transmitting property by use of diffused light such as diffuse transmission factor (transmittance of diffused light is determined by providing an integrating sphere at the rear of the sample) or opacity (white or black backing is line on the back of the sample, and the opacity is determined from the ratio of both cases). The problems in the instruments utilizing optical techniques are caused primarily through behaviors of, rectilinear light, and therefore it is particularly important to determine the linear transmission factor of a recording member for evaluation of the light transmitting property of the recording member to be used for those instruments.

For example, when the projected image of the recorded image is observed by means of OHP as a typical example of the optical instrument, it is required that the contrast between the recorded portion and the non-recorded portion is high, and also that, in order to obtain an image which is clear and can easily be viewed, the non-recorded portion in the projected image is light, namely the linear transmission factor through the recording member is at a level of a certain value or higher. In order to obtain the image suited for the above object from the test according to the test chart in OHP, the linear transmission factor through the recording member is required to be 2% or more, preferably, to obtain a more clear projected image, 10% or more. Accordingly, the light-transmissive recording member as mentioned in the present invention refers to a recording member having the total linear transmission factor of the light-transmissive substrate and the ink-receiving layer of 2% or more, preferably 10% or more.

(2) A type of recording member which has a substrate and an ink-receiving layer having a smooth surface which is provided on said substrate, where above-mentioned condensation product is contained in said ink-receiving layer:

This type of recording member is excellent in surface-gloss and particularly in ink-receiving property compared with conventional ones, and therefore may be used as a full-color recording member for observation of surface image which is excellent in definition.

As a substrate in this case, paper is preferably used, but, not restricted to this, there can be used cloth, wood, metal plate, glass plate, resinous film, synthetic paper or the like.

On the other hand, the ink-receiving layer possessed by the recording member of this type is composed of aforesaid condensation product as sole or main component. In this case, the recording member is not required to be light-transmissive contrary to the case (1) described above, but can be manufactured by the process similar to the case (1).

(3) A type of recording member which is composed of one material of film mainly comprising aforesaid condensation product:

This type of recording member of present invention, in the case of light-transmitting property, has the same characteristics as the recording member described above in case (1) and may be used for the same used, while, if it is not necessary to be light-transmissive, it has the same characteristics as the recording member described above in case (2) and may be used for the same use.

Also, this type of recording member can be manufactured by applying without modification, various kinds of conventional film manufacturing processes such as calender method, inflation method, T-die method, solution method and the like, since it can be formed similarly to various kinds of conventional thermoplastic resin films or solvent-soluble resin films.

(4) A type of recording member which has a substrate and a porous ink-receiving layer provided on said substrate, and in which is aforesaid condensation product is contained:

This type of recording member of the present invention is excellent particularly in ink-receiving property, and may be preferably used as a full-color recording member for observation of surface images which is excellent in definition.

As the substrate of this type of recording member, various kinds of materials can be used without limitation similarly to the recording member described above in case (2).

On the other hand, the ink-receiving layer possessed by this type of recording member is basically composed of filler particles and aforesaid condensation product, but other high molecular materials may be further added.

As the filler possible to be contained in the ink-receiving layer, there can be enumerated, for example, white-color type inorganic pigments such as silica, talc, clay, diatomaceous earth, calcium carbonate, calcium sulfate, barium sulfate, titanium oxide, zinc oxide, satin white, aluminum silicate, lithopone, alumina, zeolite and the like; and organic high molecular particles such as polystyrene, polyethylene, urea-formalin resin, polyvinyl chloride, polymethyl methacrylate and the like, and one or more of these may be used.

As the above-mentioned high molecular material that may be further added, there can be enumerated starch, gelatin, casein, gum arabic, sodium alginate, carboxymethylcellose, polyvinyl alcohol, polyvinylpyrrolidone, sodium polyacrylate, polyacrylamide, synthetic resin latex such as synthetic rubber latex and the like, polyvinylbutyral polyvinyl chloride, polyvinyl acetate, polyacrylonitrile, polymethylmethacrylate, polyvinylformal, melamine resin, polyamide, phenolic resin, alkyd resin or the like, and one or more of these may be added.

For forming an ink-receiving layer, a coating solution prepared by optionally dissolving or dispersing each compornent of an ink-receiving layer in a solvent may be applied onto the substrate according to various methods, then the substrate is dried as soon as possible. The coating solution is applied so that the thickness of the ink-receiving layer on the substrate may be generally about 1 to 200 μm, preferably about 5 to 80 μm.

Representative embodiment of the recording member of the present invention are described above, but, as a matter of course, the recording member of the present invention is not limited to those. In any case of those embodiments, there can be mixed various kinds of additives such as dispersants, fluorescent dyes, PH-controllers, deforming agents, Lubricants, preservatives, surfactants and the like.

By using the recording member of the present invention that contains the condensation product of the isocyanate compound and the polyether-polyol, even if inks of different colors adhere to the same portion within a short time, flowing or sunning of ink is prevented, and thus images with high resolution, clearness and excellent color-generating property is obtained. Furthermore, it is possible to provide a recording member with excellent surface gloss which conventional recording members do not have, and also possible to apply it for uses other than surface image observation which may include those in which recorded images are projected by means of optical instruments such as slide projectors and OHP on a screen, and the like for observation, color separating plate during preparation of positive plate for color printing, CMF for color display of liquid crystal, etc.

Heretofore, the method of the present invention is described in more detail according to examples.

EXAMPLE 1

Using a light-transmissive polyester film with a thickness of 100 μm (produced by Teijin Co.) as the substrate, a composition shown below was applied on the substrate by the ink-receiving layer of 25 μm, followed by drying under the conditions of 60° C. and 20 minutes to form an in-receiving layer. Thereby, a recording member of the invention containing a condensation product of an isocyanate compound and a polyether-polyol in the ink-receiving layer was formed. Composition of the composition for forming the ink-receiving layer:

| | | |
|---|---|---|
| (a) | The condensation product of the isocyanate compound and the polyether-polyol [condensation product of 6 mole of polyether-polyol (copolymer of PO and EO, PO/EO = 20/80, average molecular weight: 4500) and 1 mole of tolylenediisocyanate (T.D.I.), trade name: tricoat G, produced by Taiho Kogyo Co.] | 80 parts by weight |
| (b) | Methyl ethyl ketone | 20 parts by weight |

On the recording member of the present invention thus obtained, an ink-jet recording was effected by means of the recording device having an on-demand type ink-jet recording head by which each of four kinds of color ink as shown below is ejected through a piezovibrator (ink discharging orifice diameter: 60 μm, piezovibrator driving voltage: 70V, frequency 2 KHz) to obtain a recorded image.

| [Ink composition] | |
|---|---|
| Yellow ink | |
| C.I. Acid Yellow 23 | 2 parts by weight |
| Diethylene glycol | 25 parts by weight |
| Water | 75 parts by weight |
| Red ink | |
| C.I. Acid Red 92 | 2 parts by weight |
| Diethylene glycol | 25 parts by weight |
| Water | 75 parts by weight |
| Blue ink | |
| C.I. Direct Blue 86 | 2 parts by weight |
| Diethylene glycol | 25 parts by weight |

-continued

| [Ink composition] | |
|---|---|
| Water | 75 parts by weight |
| Black ink | |
| C.I. Direct Blue 19 | 2 parts by weight |
| Diethylene glycol | 25 parts by weight |
| Water | 75 parts by weight |

Evaluation results for recording characteristics of the recording member of the present invention fabricated in this example and for image characteristics of recorded images were shown in Table 1. Each item in Table 1 was evaluated according to the method described below.

(1) Ink fixing time was evaluated by measuring the time until the ink was dried without staining the finger, when the recording member after recording was left under the room temperature and the recording image was touched with a finger.

(2) The ink dot density was measured for black dots recorded by means of Sakura Microdensitometer PDM-5 (manufactured by Konishiroku Shashin Kogyo Co., Ltd.) by applying JIS K7650 to writing microdots.

(3) OHP aptitude was measured as a typical example of optical instrument aptitude of the recorded image and judged by observation with eyes of the recorded image which was projected on a screen by OHP, with the non-recorded portion being light and the recorded image giving a clear projected image of high OD (optical density) and high contrast being rated as (O); with the non-recorded portion slightly dark and the recorded image with slightly lower OD, showing lines with pitch width of 0.5 mm and thickness of 0.25 mm which could not clearly be discriminated from each other being rated as (Δ); with the non-recorded portion which is considerably dark and the recorded image showing lines with pitch width of 1 mm and thickness of 0.3 mm which could not clearly discriminated from each other or the recorded image which could not be discriminated from non-recorded portion being rated as (X).

(4) Straight line light transmittance was calculated, according to equation (1) described above, from the spectral transmittance measured for the recording member before practicing recording by means of Model 323 Hitachi Recording Spectrophotometer (manufactured by Hitachi Ltd.) with keeping the distance from the sample to the window on the light-receiving side at 9 cm.

(5) As to gloss, 45° specular gloss of the surface of the recording member was measured according to JIS Z8741.

EXAMPLE 2

The recording member of the present invention was prepared by the same manner as in Example 1, except for the use of an art paper (Sanyo Kokusaku Pulp Co.) as a substrate. The resulting recording member was white and opaque.

Ink jet recording was carried out using the above recording member according to the same member as in Example 1. Recording characteristic of this recording member and image characteristic of the recording image were evaluated by the same manner as in Example 1.

The results are shown in Table 1.

EXAMPLE 3

A transparent polyester film (Teijin Co.) of 100 μm in thickness was used as a substrate, on which the following composition was coated by the barcoater method to form a film of 100 μm in dry thickness. The film was dried at 80° C. for an hour to form an ink-receiving layer on the substrate. As the result, the recording member of the invention which contains a condensation product of an isocyanate compound and a polyether polyol in the ink-receiving layer was obtained.

| [Coating solution composition] | |
|---|---|
| Polyoxyethylene (Trade name, PEG#4000, produced by Nippon Yushi Co.) | 30 parts by weight |
| Glycerol | 5 parts by weight |
| Hexamethylene diisocyanate (Trade name, Dethmodjul H, produced by Sumitomo Byer Urethane Co.) | 15 parts by weight |
| Ethylacetate | 50 parts by weight |

Ink jet recording was carried out using the above recording member according to the same manner as in Example 1. Recording characteristic of this recording member and image characteristic of the recorded image were evaluated according to the same manner as in Example 1.

The results are shown in Table 1.

EXAMPLE 4

The same art paper as in Example 2 was used as a substrate.

The following coating liquid dispersed and toluidine diisocyanate (Trade name, Coronate T-100, produced by Nippon Polyurethane Industry Co., Ltd.) were mixed in the mixing ratio of 25 to 1. The resulting mixture was coated by a rubber coater on the substrate to form a film of about 25 μm in dry thickness. The film was dried at 40° C. for 20 minutes to form an ink-receiving layer on the substrate. As the result, the recording member of the present invention which contains a condensation product of an isocyanate compound and a polyether polyol in the ink-receiving layer was obtained.

| [Coating solution composition] | |
|---|---|
| EO.PO Block polymer (Trade name Emulgen PP-150, produced by Kao Corporation) | 4 parts by weight |
| Finely powdered silica (Trade name Syloid #404, produced by Fuji Davison Chemical Ltd.) | 20 parts by weight |
| Ethyl acetate | 40 parts by weight |
| Toluene | 36 parts by weight |

Ink jet recording was carried out using the above recording member according to the same manner as in Example 1 Recording characteristic of this recording member and image characteristic of the recorded image were evaluated by the same manner as in Example 1.

The results are shown in Table 1.

Comparative Example 1

A transparent polyester film (Teijin Co.) of 100 μm in thickness similar to that of Example 1 was used as a recording member. In jet recording was carried out using this recording member according to the same manner as in Example 1. Recording characteristic of the recording member used in Comparative Example 1 and image characteristic of the recorded image were evaluated by the same manner as in Example 1.

The results are shown in Table 1.

Comparative Example 2

Ink jet recording was carried out using the same art paper as in Example 2 according to the same manner as in Example 1. Recording characteristic of the recording member used in Comparative Example 2 and image characteristic of the recorded image were evaluated by the same manner as in Example 1.

The results are shown in Table 1.

TABLE 1

| | Ink fixing time | Linear transmittance | Dot density | OHP aptitude |
|---|---|---|---|---|
| Example 1 | 3 min. | 68% | 0.7 | 0 |
| Example 2 | 3 min. | — | 0.38 | — |
| Example 3 | 2 min. | 72% | 0.8 | 0 |
| Example 4 | 1 sec. | — | 0.48 | — |
| Comparative Example 1 | 4 days | 78% | 1.1 | 0 |
| Comparative Example 2 | 12 min. | — | 0.21 | — |

What is claimed is

1. A recording member having a linear transmission factor of at least 10% suitable for ink jet recording with a water-based ink which comprises an ink-receiving film of a reaction product of an isocyanate compound and a polyether-polyol; said ink-receiving film having a thickness of about 1 to 200 microns.

2. A recording member according to claim 1, wherein the isocyanate compound contains two or more isocyanate groups in one molecule thereof, and the polyether-polyol contains two or more hydroxyl groups (—OH) and ether linkage in one molecule thereof.

3. A recording member according to claim 1, wherein the ink-receiving film has a smooth surface.

4. A recording member according to claim 1, wherein the ink-receiving film comprises a mixture of said reaction product and other high molecular weight material.

5. A recording member according to claim 1, wherein the ink-receiving film further comprises a particulate filler.

6. A recording member according to claim 1, wherein the ink-receiving film has a porous constitution.

7. A recording member according to claim 1, wherein the thickness of the ink-receiving film ranges from 5 μm to 80 μm.

8. A recording member having a linear transmission factor of at least 10% suitable for ink jet recording with a water-based ink which comprises a substrate and an ink-receiving layer thereon comprising a reaction product of an isocyanate compound and a polyether-polyol; said ink receiving layer having a thickness of about 1 to 200 microns.

9. A recording member according to claim 8, wherein the thickness of the ink-receiving layer ranges from 5 μm to 80 μm.

10. A recording member according to claim 8, wherein the ink-receiving layer has a smooth surface.

11. A recording member according to claim 8, wherein the isocyanate compound contains two or more isocyanate groups in one molecule thereof, and the polyether-polyol contains two or more hydroxyl groups (—OH) and ether linkage in one molecule thereof.

12. A recording member according to claim 8, wherein the ink-receiving layer comprises a mixture of said reaction product and other high molecular weight material.

13. A recording member according to claim 8, wherein the ink-receiving layer further comprises a particulate filler.

14. A recording member according to claim 8, wherein the ink-receiving layer has a porous constitution.

* * * * *

UNITED STATES PATENT AND TRADEMARK OFFICE

CERTIFICATE OF CORRECTION

PATENT NO. : 4,911,977

DATED : March 27, 1990

INVENTOR(S) : Mouri, et al.

It is certified that error appears in the above-identified patent and that said Letters Patent is hereby corrected as shown below:

TITLE PAGE,
[57] ABSTRACT:

Line 3, "substrated" should read --substrate--.

COLUMN 3:

Line 57, "diisocyanate," should read --diisocyanate, diphenylsulfone-4,4'-diisocyanate,--.

Line 65, "Futher," should read --Further,--.

COLUMN 5:

Line 25, "N | -OCN- " should read -- H | -OCN- --.

Line 30, "N | -OCN- " should read -- H | -OCN- --.

Line 64, "gum orbic," should read --gum arabic--.

UNITED STATES PATENT AND TRADEMARK OFFICE

CERTIFICATE OF CORRECTION

PATENT NO. : 4,911,977

DATED : March 27, 1990

INVENTOR(S) : Mouri, et al.

It is certified that error appears in the above-identified patent and that said Letters Patent is hereby corrected as shown below:

COLUMN 7:

Line 21, "of," should read --of--.

COLUMN 10:

Line 40, "discriminated" should read --be discriminated--.

COLUMN 11:

Line 57, "Example 1" should read --Example 1.--.

Signed and Sealed this

Twenty-eighth Day of May, 1991

*Attest:*

HARRY F. MANBECK, JR.

*Attesting Officer*

*Commissioner of Patents and Trademarks*